US005129512A

United States Patent [19]

Garwood

[11] Patent Number: 5,129,512

[45] Date of Patent: * Jul. 14, 1992

[54] PACKAGING

[75] Inventor: Anthony J. M. Garwood, Knoxfield, Australia

[73] Assignee: Seawell North America, Inc., Wilmington, Del.

[ * ] Notice: The portion of the term of this patent subsequent to Jun. 20, 2006 has been disclaimed.

[21] Appl. No.: 547,136

[22] Filed: Jul. 3, 1990

Related U.S. Application Data

[63] Continuation of Ser. No. 381,403, Jun. 28, 1989, abandoned.

[51] Int. Cl.[5] ..... B65D 81/26; B65B 25/08; B65B 31/02

[52] U.S. Cl. ..... 206/213.1; 206/583; 53/433; 53/449; 53/472; 426/124

[58] Field of Search ..... 53/79, 170, 172, 175, 53/403, 427, 433, 434, 449, 453, 510, 511, 512, 559, 472; 206/213.1, 521.1, 583; 426/124, 129, 415, 418

[56] References Cited

U.S. PATENT DOCUMENTS

| | | | |
|---|---|---|---|
| 2,438,089 | 3/1948 | Carson | 53/449 X |
| 2,865,499 | 12/1958 | Brogren . | |
| 3,038,593 | 6/1962 | Root . | |
| 3,116,153 | 12/1963 | Seiferth et al. . | |
| 3,226,236 | 12/1965 | Weller . | |
| 3,467,244 | 9/1968 | Mahaffy et al. . | |
| 3,481,100 | 12/1969 | Bergstrom . | |
| 3,490,576 | 1/1970 | Alessi et al. . | |
| 3,514,029 | 5/1970 | Powell . | |
| 3,545,163 | 10/1967 | Mahaffy et al. . | |
| 3,574,642 | 4/1971 | Weinke . | |
| 3,624,787 | 11/1971 | Newman . | |
| 3,636,395 | 1/1968 | King . | |
| 3,679,093 | 7/1972 | Chang . | |
| 3,681,092 | 8/1972 | Titchenal . | |
| 3,686,822 | 8/1972 | Wolfelsperger . | |
| 3,695,900 | 10/1972 | Young . | |

(List continued on next page.)

FOREIGN PATENT DOCUMENTS

| | | | |
|---|---|---|---|
| 26918/67 | 9/1967 | Australia . | |
| 18600/70 | 8/1970 | Australia . | |
| 1153953 | 9/1983 | Canada . | |
| 0116394 | 8/1984 | European Pat. Off. . | |
| 1939216 | 8/1969 | Fed. Rep. of Germany . | |
| 2550388 | 11/1975 | Fed. Rep. of Germany . | |
| 2837127 | 3/1979 | Fed. Rep. of Germany . | |
| 3114508 | 11/1982 | Fed. Rep. of Germany . | |
| 2073269 | 12/1969 | France . | |
| 2165761 | 12/1971 | France . | |
| 1199998 | 7/1970 | United Kingdom . | |
| 1206023 | 9/1970 | United Kingdom . | |
| 1286917 | 8/1971 | United Kingdom . | |
| 1378140 | 12/1974 | United Kingdom | 426/124 |
| 1392580 | 4/1975 | United Kingdom . | |
| 2041318 | 9/1980 | United Kingdom . | |

*Primary Examiner*—Horace M. Culver
*Assistant Examiner*—Beth Bianca
*Attorney, Agent, or Firm*—Foley & Lardner

[57] ABSTRACT

A method of packaging goods within a packaging casing in which a substantially gas impermeable cup-shaped first casing part is provided having a depression and a peripheral lip. A web of gas permeable skin packaging material is placed over the depression and spaced from the bottom of the depression to form a space therebetween. A gas is then provided in the space. The web is sealed to the peripheral lip providing at least atmospheric pressure above to create a pressure differential above and below the web resulting in the web being stretched down inwardly of the depression. Goods are placed over the web, and an outer casing member is placed over the goods and the lip so that the permeable web is further stretched. The outer casing member is then sealed to the lip so that gas in the depression is allowed to permeate over an extended period of time through the web to the goods to enhance the keeping qualities of the goods.

6 Claims, 4 Drawing Sheets

U.S. PATENT DOCUMENTS 3,750,362 8/1973 Kishpaugh .
3,792,181 2/1974 Mahaffy et al. .
3,843,806 10/1974 Kishpaugh et al. .
3,851,441 12/1974 Marchard .
3,903,309 9/1975 Mahaffy et al. .
3,972,155 8/1976 Mahaffy et al. .
4,055,672 10/1977 Hirsch et al. .
4,058,953 11/1977 Sanborn, Jr. et al. .
4,069,348 1/1978 Bush .
4,114,348 9/1978 Mahaffy et al. .
4,201,030 5/1980 Mahaffy et al. .
4,308,711 1/1982 Mahaffy et al. .
4,340,138 7/1982 Bernhardt .
4,349,999 9/1982 Mahaffy et al. .
4,411,122 10/1983 Cornish et al. .
4,424,659 1/1984 Perigo et al. .
4,454,945 6/1984 Jabrin et al. .
4,491,225 1/1985 Baillod .
4,517,206 5/1985 Murphy et al. .
4,543,770 10/1985 Walter .
4,574,174 3/1986 McGonigle .
4,581,764 4/1986 Plock et al. .
4,622,229 11/1986 Toshitsugu .
4,683,139 7/1987 Cheng .
4,685,274 8/1987 Garwood .
4,759,444 7/1988 Barmore ..... 206/583 X
4,840,271 6/1989 Garwood ..... 206/213.1
4,903,827 2/1990 Phelps et al. ..... 206/583 X

PACKAGING

This application is a continuation of application Ser. No. 07/381,403, filed Jun. 28, 1989, which is the National Stage of PCT/AU88/00424, filed Oct. 28, 1988 now abandoned.

FIELD OF THE INVENTION

This invention relates to improved packaging and relates particularly, but not exclusively, to packaging for fresh red meats wherein the packaging can be placed on shelves for a considerable period of time without apparent degradation as to colour and/or growth of bacteria.

BACKGROUND OF THE INVENTION

Hitherto, there have been several proposals by applicant for the production of packaging of the general type concerned here. Examples are seen in applicant's prior U.S. Pat. Nos. 4,685,274 and 4,840,271, and applicant's pending application Ser. Nos. 07/488,664 and 07/499,644, all of which disclosures are incorporated herein by reference.

The present invention relates to an improvement or modification in the invention shown in at least one or more of applicant's U.S. Pat. No. 4,840,271, and applicant's pending application Ser. Nos. 07/488,664 and 07/499,644. It has been found necessary to provide for desired packaging of red meats to have a flexible web of gas permeable plastics material stretchingly engage across the meat. This arrangement places tension forces in the flexible web and makes the product more consumer acceptable.

The specification of U.S. Pat. No. 4,840,271 describes a packaging of the type shown by FIGS. 1 and 2 herein.

The specification of applicant's pending application Ser. No. 07/499,644 describes a packaging of the type shown by FIG. 3 herein.

In FIGS. 1 and 2 there is shown packaging of clear plastics material comprising a relatively rigid base 1 with an upper lid 9. Goods 3 are packaged within the base 1 and a skin wrapping material 7 skin wraps the goods 3 relative to the base 1. The skin wrapping material 7 and the lid 9 are bonded around a peripheral lip 5 as by heat bonding which seals the packaging. The lid 9 is relatively rigid and of similar thickness to that of the base 1. Both the base 1 and the lid 9 are substantially gas impervious in certain embodiments and the skin wrapping material 7 is a relatively thin web which is gas permeable. A free space 11 is provided between the skin wrapping material 7 and the lid 9 and a gas is provided within the free space 11 for enhancing preservation of the packaged goods 3. The gas can be provided to enhance the colour keeping properties as well as the non-bacteria growth properties. The flexible web 7 is gas permeable such that the gas within the free space 11 can permeate the web 7 to contact the goods 3 to enhance the keeping properties of the goods 3. It has been found that after an extended period of time, as for example several weeks, as the gas in free space 11 permeates the web 7 there is at least partial pressure equalization so that the web 7 is no longer tightly skin wrapping the goods 3. The appearance of the package can then be unpleasant and thus the package can be rejected by an intending purchaser.

In the embodiment shown in FIG. 3 the construction is very similar to that shown in FIGS. 1 and 2, but here the skin web 7 is stretched downwardly onto lower lips 13. The height of the goods 3 is above the height of the lower lips 13 and hence by bonding of the skin web 7 at region 17 to the lower lips 13, it is possible to maintain the tension displacement of the web 17 and to thus hold the goods 3 firmly to the base 1. In the embodiments shown in the above described specification of Ser. No. 07/499,644 it can be seen that the goods, particularly red meats, are in firm contact with the base of the outer container. It has been found necessary in some instances to configure the base from an opaque rigid material so that the undersurface of the meat cannot be viewed. This is because when the meat is in close contact with the base gases are unable to freely circulate to the surface of the meat which contacts the base and therefore that surface discolours dark brown. This is completely unattractive to an intending purchaser. By providing the base with an opaque material, any discolouration of the meat is not observed by an intending purchaser. However, because the base is opaque, many intending purchasers reject the package simply because they cannot view the entire surface of the meat.

We have discovered that by employing a different method for the production of the packages than hitherto proposed, adequate holding of the goods by the gas permeable flexible web(s) can be achieved. Certain embodiments enable the goods to be suspended between the base and the lid of the packaging and thus it is possible to enable the preserving gas to contact all surfaces of the goods by permeating through the gas permeable webs which are employed. This, in turn, enables both the lid and base, in certain embodiments to be made of clear transparent plastics material so that all surfaces of the goods can be observed by an intending purchaser.

OBJECTS AND STATEMENTS OF THE INVENTION

Therefore, in accordance with a first broad aspect of the present invention there is provided a method of packaging goods within an outer packaging casing, said method comprising providing a first outer packaging casing part and a second outer packaging casing part, at least one of the casing parts having a cup-shaped depression therein, and a web of skin packaging material over the depression, placing goods to be packaged between said web of skin packaging material and the other casing part, bringing the two casing parts together so that the goods stretch said web of skin packaging material, and sealing the two casing parts together so said web of skin packaging material is maintained stretchingly engaged with said goods.

In accordance with a further aspect of the present invention there may be provided apparatus for producing packaged goods within an outer packaging casing, said apparatus comprising means for placing a first outer casing packaging part over a second outer casing packaging part at least one of the casing parts having a depression therein with a web of skin packaging material over the depression, means for relatively moving the casing parts together with goods between the casing parts so that when the casing parts are together the web of skin packaging material will be stretched by contacting with said goods, and means for sealing the two casing parts together so said web of skin packaging material will be stretchingly engaged with said goods.

BRIEF DESCRIPTION OF THE DRAWINGS

In order that the present invention can be more clearly ascertained, reference will now be made to examples of particular embodiments of the invention as shown in the accompanying drawings wherein.

DETAILED DESCRIPTION OF THE PREFERRED EMBODIMENTS

Figure 1:
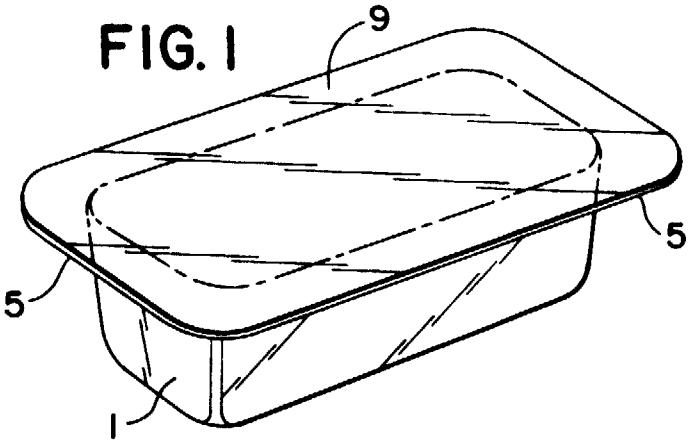
FIGS. 1 to 3 are previous embodiments of applicant referred to above.
Figure 2:
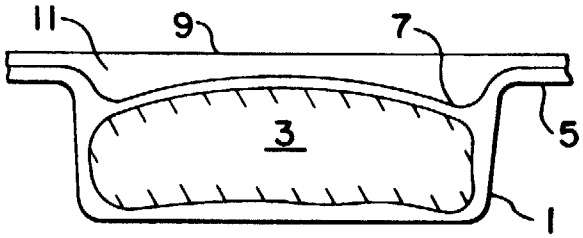
Figure 3:
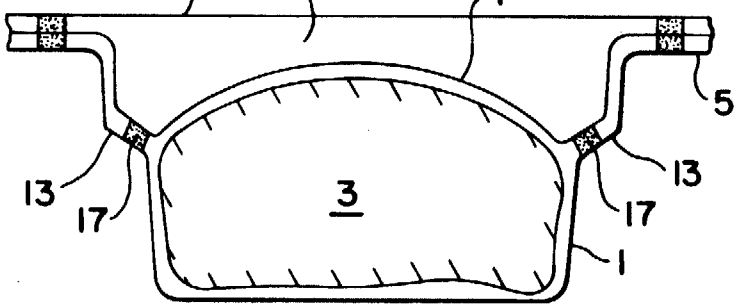

Referring now to FIGS. 4 through 7 it can be seen that a preferred package is comprised of outer casings 201 and inner envelope webs 203. The outer casing is composed of two parts—a first part 205 and a second part 207 which is substantially identical in size and shape to that of first part 205. The first part 205 is preferably hinged to the second part 207 as shown by the hinge center line 209. Preferably the first part 205 and the second part 207 are thermo-formed in line end for end from a single web of plastics material. The outer casing 201 is preferably of a plastics material such as P.V.C./P.E. formed into two distinct trays as shown. Other suitable materials comprise P.V.C., or P.V.C./E.V.A.. The thickness of the outer casing 201 is in the order of 400 microns. When P.V.C./E.V.A. is used the P.V.C. can be 400 micron thick and the E.V.A. 50 micron thick.

Layers of different plastics materials can be utilized to provide a multi-layered web to permit heat sealing together of the plastics packaging components and to provide for substantial exclusion of atmosphere into the package.

The material of the inner envelope 203 is typically of a web of flexible plastics skin wrapping material and is comprised of polyethylene or a multi-layered web of polyethylene/E.V.A. or like material(s). A typical thickness for the inner envelope 203 is approximately 20 to 25 microns thick. The inner envelope 203 can be of a linear low density polyethylene or a linear low density E.V.A. material. The inner envelope 203 is preferably heat sealed but it may otherwise be sealed around the peripheral edges of each of the portions 205 and 207 which define the outer casing 201.

A suitable gas to enhance the keeping qualities of the packaged goods, particularly the color keeping qualities, is retained between the inner envelope 203 and the outer casing 201. A suitable gas for enhancing the keeping qualities of red meat can conveniently be a combination of $O_2$ and $CO_2$ and/or nitrogen or any one of those gases. Other gases known for enhancing the keeping properties of the packaged goods can be used if desired. Typically, the gas is in the percentage of 20% $CO_2$ and 80% $O_2$. The $O_2$ assists in retaining the red color of red meats whilst the $CO_2$ inhibits the growth of bacteria. The gas is at a pressure slightly less than atmospheric pressure and hence the inner envelope web 203 is urged by atmospheric pressure into each respective casing 205 and 207. The plastics material chosen for webs of the inner envelope 203 is preferably such that certain gas can permeate therethrough. It is particularly preferred that the webs of inner envelope 203 allow $O_2$ to readily permeate therethrough.

Goods 213, such as red meats or other fresh foods or other goods, are then placed on one of the halves of the package. It can be seen that the goods 213 are placed onto the web of the inner envelope 203 causing it to stretch downwardly slightly. This is shown in the second part 207 in FIG. 5. The first part 205 is then swung about hinge center line 209 like the swinging of a clam shell, so that the first part 205 lies directly above the second part 207. When the first part 205 is closed over the second part 207 so that the peripheral flanges of each of the trays mate in abutting relationship, the goods 213 cause deformation of the web of the inner envelope 203 in the first part 205 and possibly further deformation of the web of the inner envelope 203 in the second part 207. Thus, the webs of the inner envelope 203 are stretched both in the first part 205 and in the second part 207. The webs are also stretched across the flanges of each of the trays of the outer casing 201.

Figure 7:
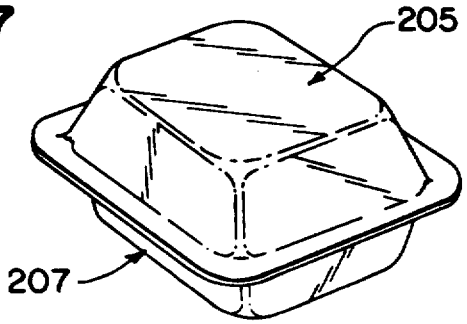
FIG. 7 is a top perspective view of the closed package.

A suitable gas such as of the type previously described may be provided in the space between the webs of the inner envelope 203 in the first part 205 and second part 207. This gas can be at a pressure less than atmospheric and less than the pressure of the gas between the respective webs of inner envelopes 203 and the first part 205 and the second part 207. The flanges of the trays of the outer casing 201 will align and can then be heat sealed together to form a sealed closed packaging as shown in FIG. 7.

The above packaging suspends the goods between the outer casing 201. The webs of the inner casing 203 are of a material which allows certain gases such as $O_2$ to pass and thus the $O_2$ in the gas which is in the spaces 211 can pass through the webs of the inner casing 203 and contact the outer surface of the goods 213. Certain gases which may exude or be generated by the packaged goods can pass through the webs of the inner casing 203.

Because the webs of the inner casing 203 are stretched over the goods 3, the webs will remain stretched should there be a tendency for gas pressure equalization between the space inside the inner casing 203 of the package, and between the inner casing 203 and the first part 205 and second part 207 after a period of time.

Figure 8:
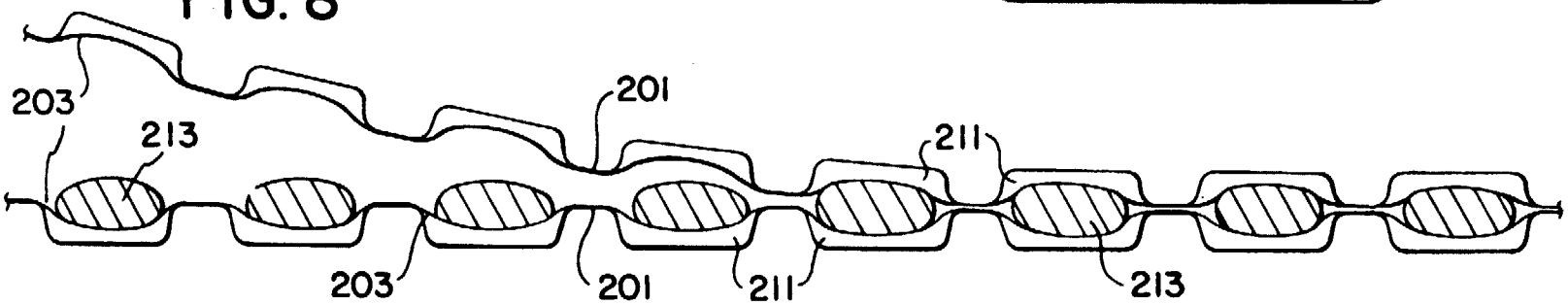
FIG. 8 is a side cross-sectional view showing a variation of a manufacturing method for providing the packaging.
Figure 4:
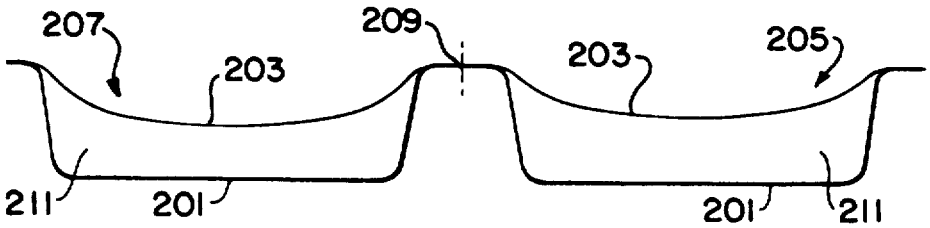
FIG. 4 is a side sectional view of one form of preferred packaging according to the present invention prior to loading of goods therein.
Figure 5:
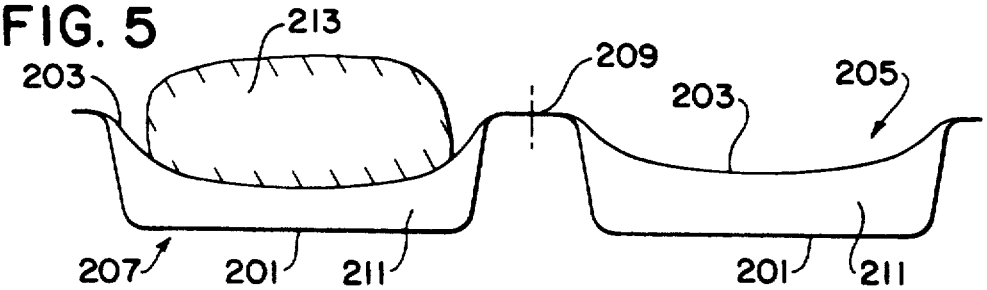
FIG. 5 is a view similar to FIG. 4 showing goods loaded therein.
Figure 6:
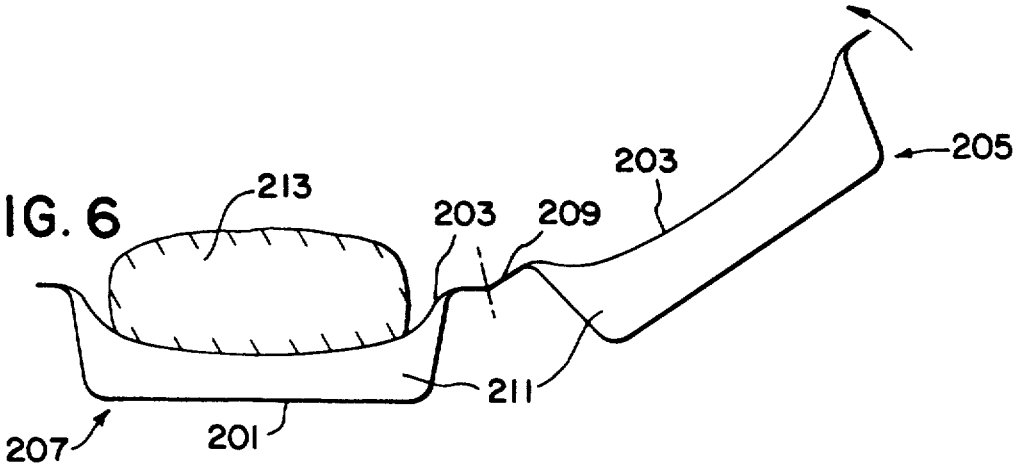
FIG. 6 is a view similar to FIGS. 4 and 5 showing closing of the packaging.

FIG. 8 shows a variation where instead of having a hinge connection between a first part 205 and a second part 207 so that the portions hinge together in a clam shell arrangement, there is provided two distinct webs of outer casing material 201, each with a plurality of tray depressions formed therein. Respective inner casing webs 203 can be provided across the depressions in each of outer casing webs 201. Suitable gases for enhancing the keeping properties of the packaged goods can be provided in the spaces 211 between the webs of outer casings 201 and webs of inner casings 203. The webs of inner casing 203 can be heat sealed to the outer casing 201 thereby retaining that gas in the space 211. The two webs of outer casings 201 can be brought together so that each depression is in alignment, and prior to the two being brought together, goods 213 can be placed on the lower of the webs. Thus, when the webs are brought together the inner casings 203 in each will stretch over the goods 213 and suspend the goods 213 spaced from the outer casing 201. The two webs of outer casing 203 can then be sealed by a heat sealing member to provide individual sealed packages.

Figure 9:
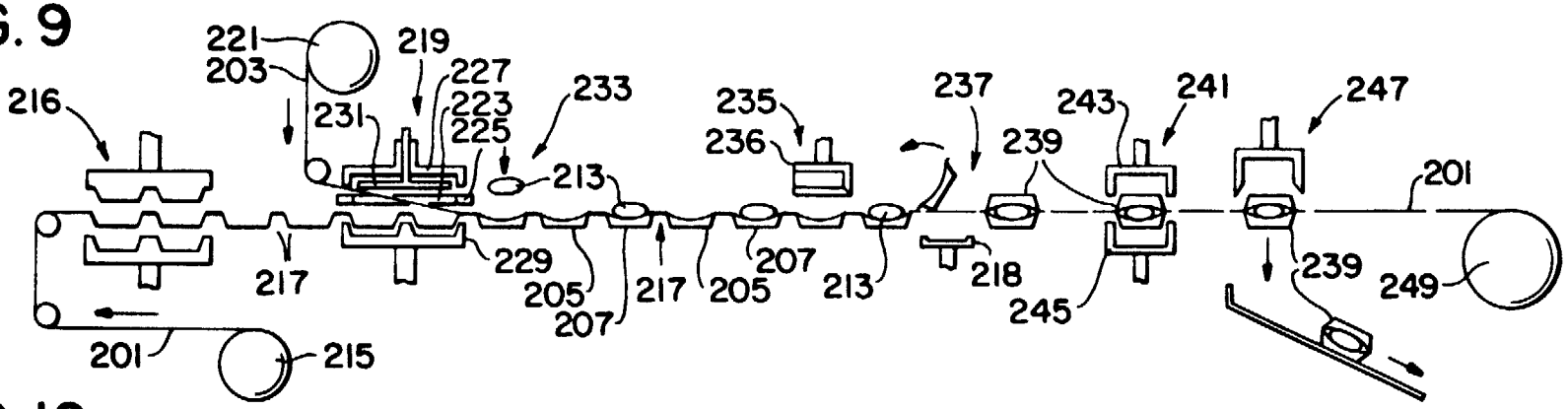
FIG. 9 is a schematic view showing in diagrammatic form a typical packaging machine for producing the packaging shown in FIGS. 4 through 7.

FIG. 9 shows a schematic diagram of a preferred machine for producing packages in accordance with FIGS. 4 through 7.

A web of outer casing material 201 is fed from a stock roll supply 215. The web 201 passes to a thermo-forming station 216 where two tray shaped depressions are formed simultaneously end for end repetitively in the web 201. The two tray shaped depressions can be considered as a pair 217 one of which will constitute the first part 205 and the other of which will constitute the second part 207. The pair of trays 217 then pass to an inner casing and gas sealing station 219. The station 219 is substantially identical to the station for gas flushing and sealing shown in aforementioned U.S. Pat. No. 4,685,274. A web of inner casing material 203 is supplied from a stock supply 221 and passes diagonally through an aperture 223 in a gas flushing plate 225. An upper chamber 227 and a lower chamber 229 are then closed onto the gas flushing plate 225 and gas emitted from the plate 225 underneath the web of inner casing 203 which extends diagonally between the gas flushing plate 225. A heated platen 231 can then be lowered to heat seal the inner casing material 203 around the peripheral edges of each of the depressions in the pair of depressions 217. Full details of the arrangement at station 219 can be ascertained from reading the aforementioned U.S. Pat. No. 4,685,274.

As the pair of depressions 217 leave the inner casing and gas sealing station 219, they pass to a goods loading station 233 where goods 213 can be placed into the second part 207 of the pair of depressions 217.

The pair of depressions 217 then pass to a severing station 235 where only the first part 205 is severed from the web by a punch 236 around three sides of its depression. It is left interconnected with the flange along the edge which adjoins the depression of the second part 207. Thus, the second part 207 is retained relative to the web 201 whilst the first part 205 is severed such that it can swing relative to the web 201.

The severing station 235 may precede the goods loading station 233 if desired.

The pair of depressions 217 then advance to a casing closing station 237 where the first part 205 is caused to swing by a casing moving part 218 upwardly relative to the web 201 to close the packaging.

The closed packaging 239 is then advanced to a gas flushing and heat sealing station 241. Here the gas flushing and heat sealing station 241 comprises an upper chamber part 243 and a lower chamber part 245 which are closed and in which a gas is injected so as to supply such gas between the webs of inner casings 203 and to contact the goods 213. Electrical impulse heat sealing surfaces (not shown) on the edges of the upper chamber part 243 which abut with the lower chamber part 245 can then be activated to heat seal the first part 205 to the second part 207.

The packaging 239 is therefore sealed closed with a desired gas in the space 211 and with the inner casing 203 stretched over the goods 213. A desired gas is also between the inner casings 203 and contacting the goods 213. The closed packaging 239 is still retained in the web 201. Accordingly, it then passes to a punching station 247 where it is punched from the web 201 to cause it to fall by gravity to be discharged to a suitable collection area. The waste material in the web 201 can be rolled into a waste roll 249 for subsequent re-use.

Figure 10:
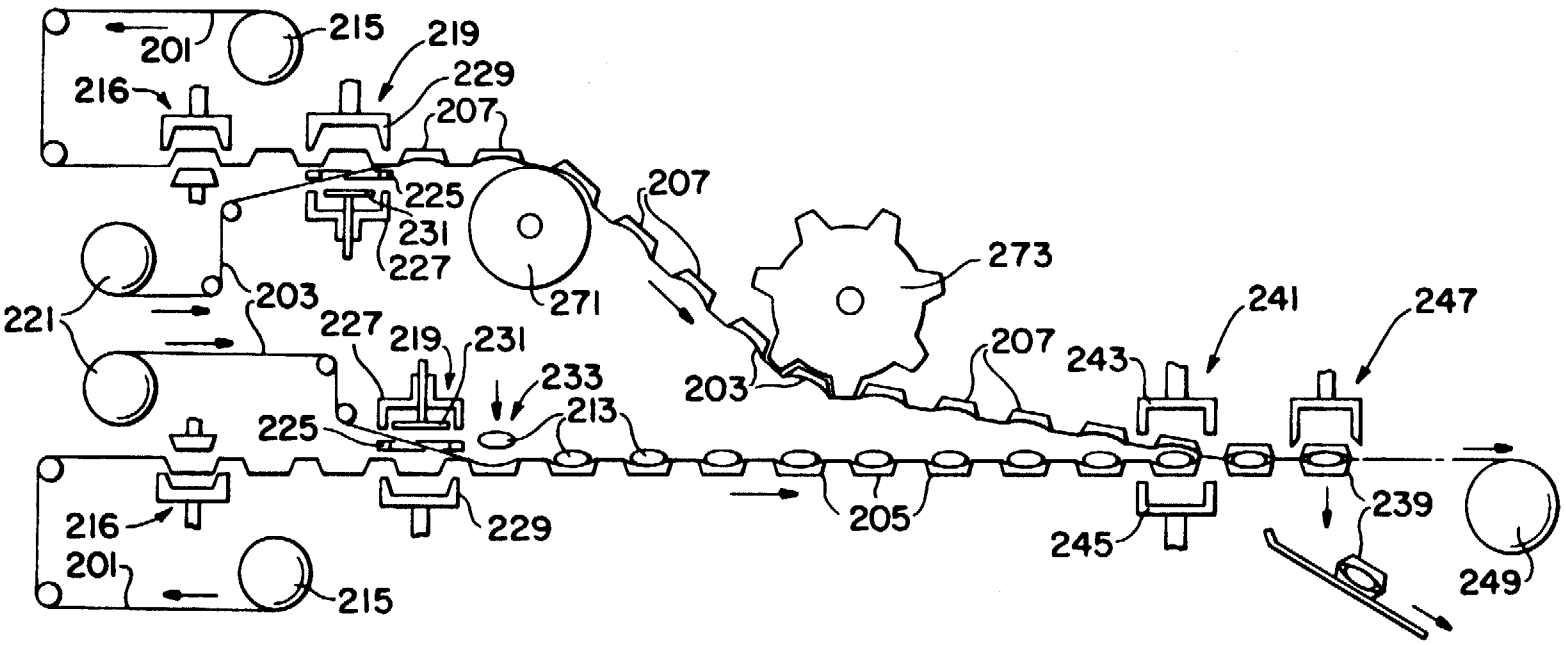
FIG. 10 is a schematic view showing in diagrammatic form a typical packaging machine for performing the method shown in FIG. 8.

Referring now to FIG. 10 there is shown an embodiment of apparatus for producing packaging according to the method shown in FIG. 8. Like components to those shown in the machine in FIG. 9 have been provided with the same designations. The schematic diagram is basically self explanatory. It can be seen that there are provided upper and lower webs 201 and respective thermo-forming stations 216 and gas sealing stations 219. Each of the upper and lower webs 201 provides respectively the first container part 205 and the second container part 207. After goods have been loaded at the goods loading station 233 into the first container part 205, the depressions pass to the heat sealing station 241 where the first container parts 205 and the second container parts 207 are brought together and heat sealed. It can be seen that the second container parts 207 pass over a roll 271 and then under a further toothed roll 273 so that the respective depressions in each of the webs can be brought into alignment.

The machines and methods described above produce a package 239 which contains goods such as red meat encapsulated and suspended between two membranes of thin, highly gas permeable, flexible materials. This is all contained with an outer casing 201 of transparent plastics material which allows inspection of the red meat from all sides in a condition which is appealing to the intending purchaser.

In order to aid speed of production, the machines shown in FIGS. 9 and 10 can be arranged to produce a series of pairs of depressions 217 across a wide web 201 so that more than one pair of depressions 217 is processed simultaneously at each of the various stations.

FIGS. 11 through 15 show variations of packaging which can be produced in accordance with the above methods and by the above apparatus. The packaging has the same designations for the various parts as that in the previous embodiments. In the embodiment shown in FIG. 11 the second container part 207 does not include a web of skin packaging material. The second container part 207 is rigid relative to the web of skin packaging material 203 retained within the first container part 205. Typically, the second container part may be of non-transparent plastics of the same material and same thickness as that described for the previous embodiments. When the first container part 205 and second container part 207 are sealed together at seal 281 the second container part presses directly against the goods 213 and stretches the web of skin packaging material 203. The necessary preserving gas can be retained between the web of inner casing 203 and the first container part 205 if desired. Such gas will assist the keeping qualities of the packaged goods by permeating through the web of the inner casing 203.

Figure 12:
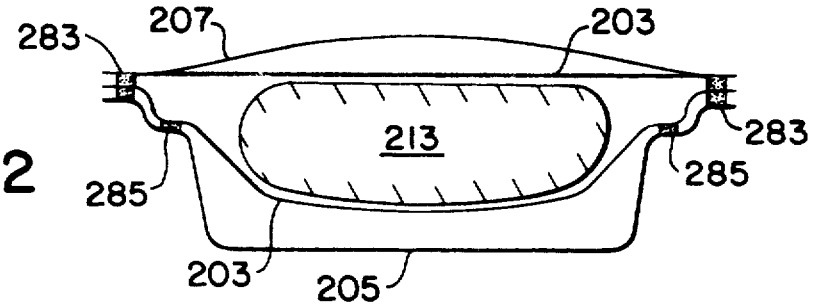
FIG. 12 is a side view of a further embodiment of packaging according to the present invention.

FIG. 12 shows an embodiment similar to that previously described except that the first container part 205 has an upper peripheral lip 283, and a further lip 285 intermediate the upper lip 283 and the bottom of the depression in the first container part 205. Here it can be seen that the webs of the inner casing 203 are bonded to the peripheral lip. Preferably the peripheral lip 285 is continuous around the first container part 205 and the sealing is continuous around the lip 285. The second container part 207 has its respective web of inner casing 203 sealed thereto with a desired gas for enhancing the keeping qualities of the packaged goods 213 therein. Similarly, a desired gas for enhancing the keeping properties of the packaged goods 213 can be placed between the web of inner casing 203 and the first container part 205 prior to the sealing on the intermediate lip 285. The first container part 205 and second container part 207 can then be bonded at the upper peripheral lip 283 to hold the package together and to provide the necessary stretching in the webs of inner casing 203.

Figure 13:
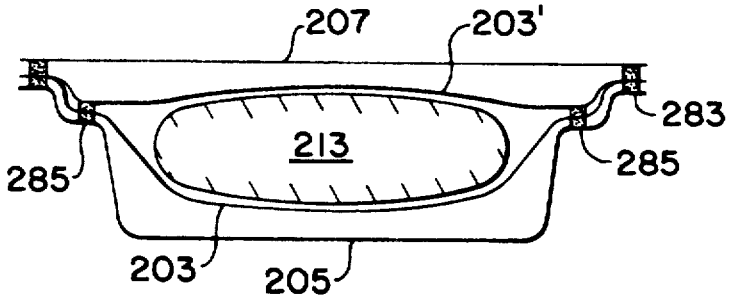
FIG. 13 is a side view of a still further embodiment of the packaging of the present invention.

The embodiment shown in FIG. 13 is very similar to that shown in FIG. 12 except that it is necessary to provide a web of inner casing 203 over the goods 213 and seal it to the further lip 285 prior to sealing the second container part 207 at the upper peripheral lip 283. A desired gas for enhancing the keeping properties of the packaged goods 213 can be provided in the space between the web of the inner casing 203 and the second container part 207.

Figure 14:
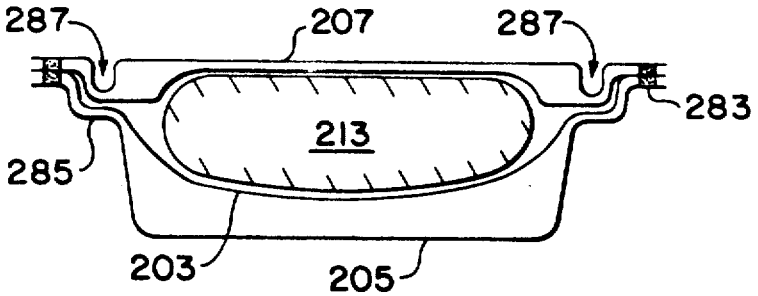
FIG. 14 is a side view of another embodiment of packaging according to the present invention.
Figure 15:
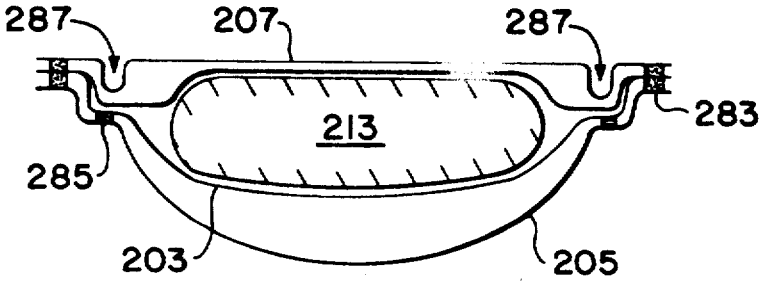
FIG. 15 is a side view of a further embodiment of packaging in accordance with the present invention.

The embodiments of FIGS. 14 and 15 are substantially identical to each other but here it can be seen that the second container part 207 is like a lid which has a peripherally extending projection means 287. When the lid is fitted to the first container part 205 it will urge the web of the inner container 203 into an even further stretching relationship over the goods 213 than that provided by any of the previously described embodiments. In this connection, the sealing can be at the upper peripheral lip 283. FIG. 15 is different to FIG. 14 in that a web of inner casing 203 is first bonded to the further lip 285 of the first container part 205 prior to the lid being applied thereto. The lid is sealed at the upper peripheral lip 283 when it is fitted to the first container part 205. If desired the first container part 205 may be of relatively flexible material such that the first container part 205 and the integrally attached web of inner casing 203 form a flexible bag onto which the goods 213 are received. Desirably, the first container part 205 can be made of a strong plastics material sufficient to withstand the pressure of a person's finger pressing thereon to feel the goods 213 packaged within the package. In this connection it has been found that with red meat some purchasers like to press the meat to see if it meets their degree of firmness. By having the first container part 205 of such a flexible material it will inhibit rupturing of the first container part 205 when this pressing action occurs.

Figure 11:
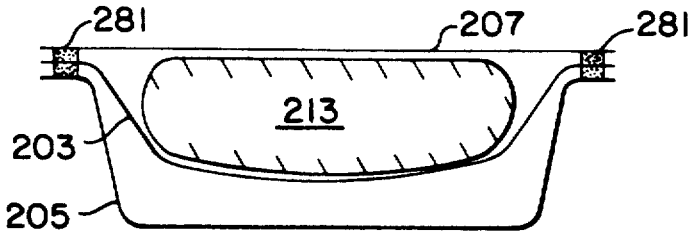
FIG. 11 is a side view of a further modification of packaging according to the present invention.

In the embodiments shown in FIGS. 11, 14 and 15, the lid may be of a non-transparent material in order that any darkening of red meats, which may occur as a result of the goods 213 contacting or spreading over the undersurface of the lid and prohibiting the gas which is within the packaging to contact all surfaces of the red meat will not be visible.

In the embodiments shown in FIGS. 12, 13 and 15, the desired gas is sealed relative to the first casing part 205 and web of inner casing 203 prior to the goods 213 being loaded into the packaging. Thus, problems which could be encountered by contamination of the sealing surfaces such as at the upper peripheral lip by contamination from the goods 213 as they are loaded is avoided. Accordingly, the gas can be securely retained within the first container part 205.

In the embodiment shown in FIGS. 14 and 15, the second container part 207—the lid—may be sealed around the upper peripheral lip 283 prior to being sealed to the first container part 205. The necessary desired gas may be placed between the web of inner casing 203 and the second container part 207 prior to such sealing.

In any of the embodiments described herein it is not essential to include a gas to enhance the keeping qualities of the packaged goods. In such circumstances the gas which is in the package between the web of skin packaging, i.e. the web of inner casing 203 and the first container part 205, the web of inner casing 203 and the second container part 207, may be atmosphere. Such packaging may have use in certain applications and for certain goods.

Further, it is not essential to provide a gas to enhance the keeping qualities of teh packaged goods within the inner casing 203 but it is considered preferable.

Modifications may be made to the invention as would be apparent to persons skilled in the packaging arts.

These and other modifications may be made without departing from the ambit of the invention, the nature of which is to be determined from the foregoing description and by the appended claims.

The claims defining the invention are as follows:

I claim:

1. A method of packaging goods within a packaging casing, comprising the steps of:

a) providing a substantially gas impermeable cup-shaped first casing part having a depression and a peripheral lip, b) placing a web of gas permeable skin packaging material over said depression and spaced from the bottom of the depression to form a space therebetween, c) providing a gas in said space at a pressure less than atmospheric, d) sealing said web to said peripheral lip, e) providing at least atmospheric pressure above said web thereby resulting in the web being stretched down inwardly of said depression, f) placing goods over said web, g) placing an outer casing member over said goods and said lip so that said permeable web is further stretched, and h) sealing said outer casing member to said lip whereby gas in said depression is allowed to permeate over an extended period of time through said web to said goods to enhance the keeping qualities of the goods.

2. The method of claim 1, wherein said outer casing member similarly comprises a substantially gas impermeable cup-shaped casing part and a gas permeable web, the method further comprising the steps of:

a) forming an assembly of a cup-shaped outer casing having a depression and a peripheral lip, and a stretched gas permeable web sealed to the said lip;

b) combining said first casing and said outer casing one above the other, with the goods disposed between the gas permeable webs of each casing, and c) sealing said casings together at their peripheral lips so as to further stretch said webs around said goods.

3. The method of claim 2, wherein said first and outer casings are interconnected, and further including the step of swinging said outer casing relative to said first casing so that said parts are superimposed as aforesaid.

4. Packaging for enhancing preservation of packaged goods, said packaging comprising a base part and a lid part, at least one of said parts having a substantially gas impermeable outer shell with a cup-shaped depression therein, a gas permeable flexible web of material sealed across said depression and retaining a gas within said depression which can permeate said flexible web, the pressure of the gas being below atmospheric pressure and said flexible web being bowed inwardly of said depression, the other of said lid or base being substantially gas impermeable, said lid part being sealed over said base part with goods packaged therebetween, the closing and sealing of both parts permitting the goods to stretch said flexible web to bow further into said depression, the gas in said depression permeating said flexible web over a substantial period of time to enhance preservation of said goods.

5. Packaging as claimed in claim 4, wherein the other of said lid or base also has a substantially gas impermeable outer shell with a cup-shaped depression therein, a gas permeable flexible web of material sealed across said depression and retaining a gas within said depression which can permeate said flexible web, the pressure of the gas being below atmospheric pressure and said web being bowed inwardly of said depression, and wherein said closing and sealing of both parts results in both flexible webs stretching further into their respective depressions, and wherein the gas in each respective depression can permeate its associated flexible web over a substantial period of time to enhance preservation of said goods.

6. Packaging as claimed in claim 5, wherein the lid and base parts are interconnected prior to sealing said base and said lid together with goods therebetween, said interconnection permitting swinging of one part relative to the other so the lid and base can be closed in a manner like that of the closing of a clam shell.

* * * * *